US007448371B2

(12) United States Patent
Sapir

(10) Patent No.: US 7,448,371 B2
(45) Date of Patent: Nov. 11, 2008

(54) MULTI-PURPOSE PROPULSION DEVICE

(75) Inventor: David Sapir, Plymouth, MA (US)

(73) Assignee: Sapir, LLC, Kingston, MA (US)

( * ) Notice: Subject to any disclaimer, the term of this patent is extended or adjusted under 35 U.S.C. 154(b) by 0 days.

(21) Appl. No.: 11/177,548

(22) Filed: Jul. 8, 2005

(65) Prior Publication Data

US 2007/0006861 A1 Jan. 11, 2007

(51) Int. Cl.
*F41B 7/00* (2006.01)

(52) U.S. Cl. ..... 124/16; 124/17

(58) Field of Classification Search ..... 124/16, 124/17, 20.1

See application file for complete search history.

(56) References Cited

U.S. PATENT DOCUMENTS

| | | | | | |
|---|---|---|---|---|---|
| 75,767 | A | * | 3/1868 | Keyes | 124/16 |
| 221,694 | A | * | 11/1879 | Mulholland | 124/16 |
| 1,827,023 | A | * | 10/1931 | Keseleff | 124/17 |
| 2,663,291 | A | * | 12/1953 | Hall | 124/17 |
| 3,579,896 | A | | 5/1971 | Flottorp | |
| 3,857,379 | A | | 12/1974 | Burghardt | |
| 3,874,359 | A | | 4/1975 | Cesin | |
| 3,949,729 | A | | 4/1976 | Pfotenhauer | |
| 3,949,731 | A | | 4/1976 | Caso | |
| 4,086,901 | A | | 5/1978 | Clement | |
| 4,089,318 | A | | 5/1978 | Hesener | |
| 4,154,012 | A | | 5/1979 | Miller | |
| 4,165,729 | A | | 8/1979 | Niemirow | |
| 4,169,453 | A | | 10/1979 | Hunsicker | |
| 4,195,615 | A | | 4/1980 | Belokin | |
| 4,278,065 | A | | 7/1981 | Wales | |
| 4,297,985 | A | | 11/1981 | Rodriguez | |
| 4,373,503 | A | | 2/1983 | Saunders | |
| 4,386,478 | A | | 6/1983 | Belokin | |
| 4,386,598 | A | | 6/1983 | Blaser | |
| 4,710,146 | A | | 12/1987 | Rasmussen et al. | |
| 4,784,106 | A | | 11/1988 | Kees | |
| 4,803,970 | A | | 2/1989 | Mattheck et al. | |
| 4,805,583 | A | | 2/1989 | Mosser | |
| 4,807,585 | A | | 2/1989 | Gegere | |
| 4,852,543 | A | | 8/1989 | Mosser | |
| 4,911,136 | A | | 3/1990 | Brown | |
| 5,224,464 | A | | 7/1993 | Burnham et al. | |

(Continued)

OTHER PUBLICATIONS

PCT/US06/26460, International Search Report and Written Opinion Sep. 21, 2006.

*Primary Examiner*—John Ricci
(74) *Attorney, Agent, or Firm*—Wolf, Greenfield & Sacks, P.C.

(57) ABSTRACT

A device for projecting various types of objects is provided. The device includes a projectile mount configured to hold an object for projecting, a housing with a passageway therethrough, and a retractor mechanism coupled to the projectile mount for movement therewith relative to the housing. At least one resilient member is coupled to the housing and the retractor mechanism, such that when the retractor mechanism is drawn away from the housing, the resilient member stores energy, and relative movement of the retractor mechanism back towards the housing transfers the stored energy into movement of the projectile mount and the object. The device may be utilized as a toy, or for various recreational, military, or rescue purposes. Further, by employing an adaptor on the projectile mount, the device may be configured to project a wide variety of sized and shaped objects.

20 Claims, 8 Drawing Sheets

U.S. PATENT DOCUMENTS 5,243,955 A 9/1993 Farless
5,247,920 A * 9/1993 Harbin ..... 124/20.1
5,355,866 A 10/1994 Hunter
5,415,151 A 5/1995 Fusi et al.
5,551,412 A 9/1996 Warnke
5,579,749 A 12/1996 Wilkinson
5,619,978 A 4/1997 Flournoy
5,671,722 A 9/1997 Moody
5,690,089 A 11/1997 Ward
5,735,074 A 4/1998 Stauffer
5,762,056 A 6/1998 Kysilka
5,803,060 A 9/1998 Skivran
5,970,970 A 10/1999 Vanek et al.
5,979,424 A 11/1999 Alvarez et al.
6,076,511 A 6/2000 Grimm et al.
6,079,398 A 6/2000 Grimm
6,112,733 A 9/2000 Wooten et al.
6,152,123 A 11/2000 Ferrante et al.
6,179,680 B1 1/2001 Hornsby et al.
6,273,078 B1 8/2001 Schwesinger
6,286,495 B1 * 9/2001 Brown ..... 124/20.1
6,460,527 B1 10/2002 Doepner
6,599,161 B2 7/2003 Hunter
6,648,726 B2 11/2003 Hornsby et al.
6,672,239 B1 * 1/2004 Gieseke ..... 114/316
6,733,356 B2 5/2004 Lee
6,742,509 B2 6/2004 Hunter et al.
6,823,855 B2 11/2004 Omi

* cited by examiner

MULTI-PURPOSE PROPULSION DEVICE

FIELD OF INVENTION

The present invention relates generally to a device for projecting or propelling an object, and more particularly to a device which projects or propels an object using a movable mount.

DISCUSSION OF RELATED ART

There are various types of devices that currently exist to propel or project an object through the air. Some examples of such devices include toys or sporting devices like a sling shot, or a bow and arrow. Other recreational and/or military devices are known to project or propel an object through air or water. These devices may employ more complex systems, including compressed air chambers, pistons, triggers, latches, pulleys, springs, or gun powder. Examples of such devices are found in the following patents: U.S. Pat. Nos. 3,579,896; 3,949,731; 4,086,901; 4,165,729; 4,297,985; 5,671,722; 5,979,424; 6,599,161; and 6,742,509.

SUMMARY OF INVENTION

In one aspect, a device for projecting an object is disclosed. In one embodiment of this aspect, the device includes a projectile mount configured to hold an object to be projected, and a housing. The device also includes a retractor mechanism coupled by a linkage to the projectile mount for producing movement of the projectile mount relative to the housing. At least one resilient member is further provided. The resilient member has a first end coupled to the housing and a second end coupled to the retractor mechanism. Relative movement of the retractor mechanism away from the housing stores energy in the resilient member, and relative movement of the retractor mechanism towards the housing transfers the stored energy into the movement of the projectile mount.

In another embodiment of this aspect, the device includes a projectile mount configured to hold an object to be projected, and a housing. The device also includes a retractor mechanism coupled by a linkage to the projectile mount for producing movement of the projectile mount relative to the housing. The retractor mechanism has a front face, and the housing has a back face defining a strike plate. The retractor mechanism is axially aligned with the housing, such that the front face of the retractor mechanism is adjacent the strike plate in a first position. The device also includes at least one resilient member coupled to the housing and the retractor mechanism. Relative movement of the front face of the retractor mechanism from the first position to a second position in which the front face of the retractor mechanism is spaced apart from the strike plate stores energy in the at least one resilient member. Release of the retractor mechanism allows the retractor mechanism to return to the first position which transfers the stored energy into movement of the retractor mechanism and the projectile mount.

In yet another aspect, a hand-held modular kit for projecting an object is disclosed. The kit includes a device including a housing, a projectile mount extending from the housing, where the projectile mount is configured to hold an object to be projected, and a retractor mechanism removably coupled to the projectile mount for producing movement of the projectile mount relative to the housing. The kit further includes a plurality of resilient members. The resilient members are configured to be removably coupled to the housing and the retractor mechanism. At least a portion of the plurality of resilient members have different elasticity values, to vary the force required to move the retractor mechanism away from the housing. The device is configured such that at least one resilient member is coupled to the housing and the retractor mechanism, and when the at least one resilient member is coupled to the housing and the retractor mechanism, movement of the retractor mechanism with respect to the housing stretches the resilient member. Release of the retractor mechanism allows the retractor mechanism to move toward the housing and thrusts the projectile mount forward to project an object from the projectile mount. The kit further includes a plurality of adaptors that are configured to be removably coupled to the projectile mount. The adaptors have a variety of configurations to hold various types of objects, and the device is configured such that at least one adaptor is coupled to the projectile mount.

In yet one more aspect, a method of propelling a projectile is disclosed. The method includes the step of providing a hand-held device comprising a housing, a projectile mount having an end extending from the housing, a retractor mechanism coupled to the projectile mount and at least one resilient member coupling the retractor mechanism to the housing. The method further includes the steps of frictionally engaging the projectile with the end of the projectile mount, and manually moving the retractor mechanism with respect to the housing to store potential energy in the resilient member. Thereafter, the retractor mechanism is released to allow transfer of potential energy from the resilient member to the projectile mount to propel the end of the projectile mount away from the housing. The method further includes the step of arresting movement of the projectile mount after travel through a predetermined distance to cause the transfer of kinetic energy in the projectile mount to the object, and releasing the object from the projectile mount after receipt of the kinetic energy from the projectile mount.

BRIEF DESCRIPTION OF DRAWINGS

Various embodiments of the invention will now be described, by way of example, with reference to the accompanying drawings, in which.

DETAILED DESCRIPTION

Figure 1:
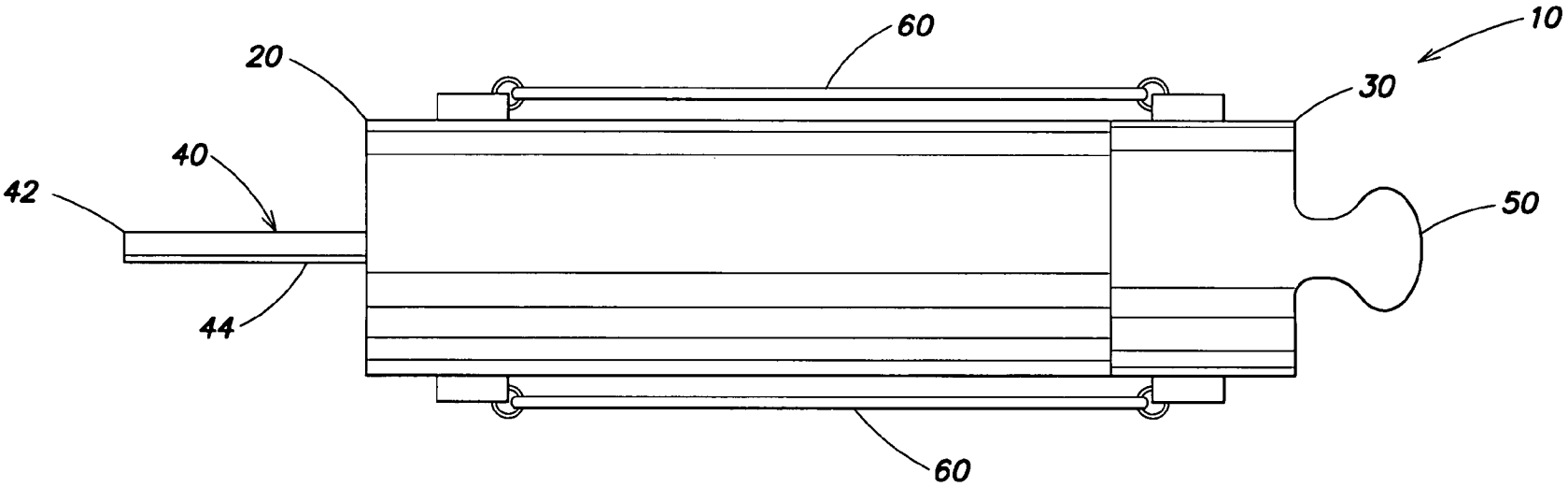
FIG. 1 is an elevation side view of a device for projecting an object according to one embodiment of the present invention.

Aspects of the invention relate to a propulsion device having a variety of applications and configurations. In particular, some aspects of the invention relate to a device for projecting or propelling various types of toys or sporting devices into the air, while other aspects of the invention relate to a device which may have a variety of practical uses. For example, the present invention may have survival applications, and military applications, such as the deployment of weapons.

As will be explained in further detail below, the propulsion device of the present invention typically includes four primary components: a housing, a retractor mechanism, a projectile mount, and one or more resilient members. The projectile mount is coupled to the retractor mechanism for movement in response to the retractor mechanism. The projectile mount holds an object prior to the object being propelled from the device. Once the object is positioned with respect to the mount, the retractor mechanism is moved relative to the housing. At least one resilient member is secured to the retractor mechanism. The resilient member is also anchored to another portion of the device, such as the housing. As the retractor mechanism moves away from the housing, potential energy is stored in the resilient member. Thereafter, the retractor mechanism is released, converting the potential energy in the resilient members into movement of the retractor mechanism and projectile mount. Once the retractor mechanism reaches its original position, adjacent the housing, the remaining kinetic energy is transferred to propel an object from the projectile mount.

As explained below, a user may provide the energy needed to produce this relative movement between the retractor mechanism and housing, either manually, or through a mechanism which may be automated. In one embodiment, the user also controls exactly when the object is fired from the device, by controlling when the projectile mount is released to return to its original position.

In some instances, it may be desirable to have a single propulsion device system which may be used for a variety of different applications. Accordingly, in one embodiment, a multi-purpose propulsion device system incorporating the above four primary components is provided.

In some embodiments, a user may configure the device to his/her specific application. For example, in one embodiment, a user can make adjustments to control how far and how fast an object will be propelled from the device. In another embodiment, the user can add an adaptor to the projectile mount so that the device is capable of projecting or propelling a particular sized or shaped object. In yet another embodiment, safety features may be added to the propulsion device to minimize the risk typically associated with various types of devices.

Turning now to the drawings, it should be appreciated that the drawings illustrate various components and features which may be incorporated into various embodiments of the present invention. For simplification, several drawings may illustrate more than one optional feature or component. However, the present invention is not limited to the specific embodiments disclosed in the drawings. It should be recognized that the present invention encompasses embodiments which may include only a portion of the components illustrated in any one figure, and/or may also encompass embodiments combining components illustrated in multiple different drawings.

In FIG. 1, a device 10 is shown for projecting or propelling an object according to one aspect of the invention. The device 10 includes a projectile mount 40 and a housing 20 having a passageway therethrough. A first end 42 of the mount 40 may be configured to hold an object. The mount 40 is coupled to a retractor mechanism 30 by linkage 44 for movement in response to the retractor mechanism 30 relative to the housing 20. At least one resilient member 60 is coupled to the retractor mechanism 30. Resilient member 60 is anchored, preferably to housing 20. When the retractor mechanism 30 is moved away from the housing 20, energy is stored in the resilient member 60 as it is stretched. When the retractor mechanism 30 is released, the energy stored in the resilient member 60 causes return movement of the retractor mechanism 30 toward housing 20. Release of the retractor mechanism may also cause movement of the projectile mount 40, for example, movement of the first end 42 of the projectile mount 40 away from housing 20. Once the retractor mechanism strikes the housing 20, the kinetic energy of movement is imported to the object which is projected or propelled away from the projectile mount 40.

Housing

Figure 2:
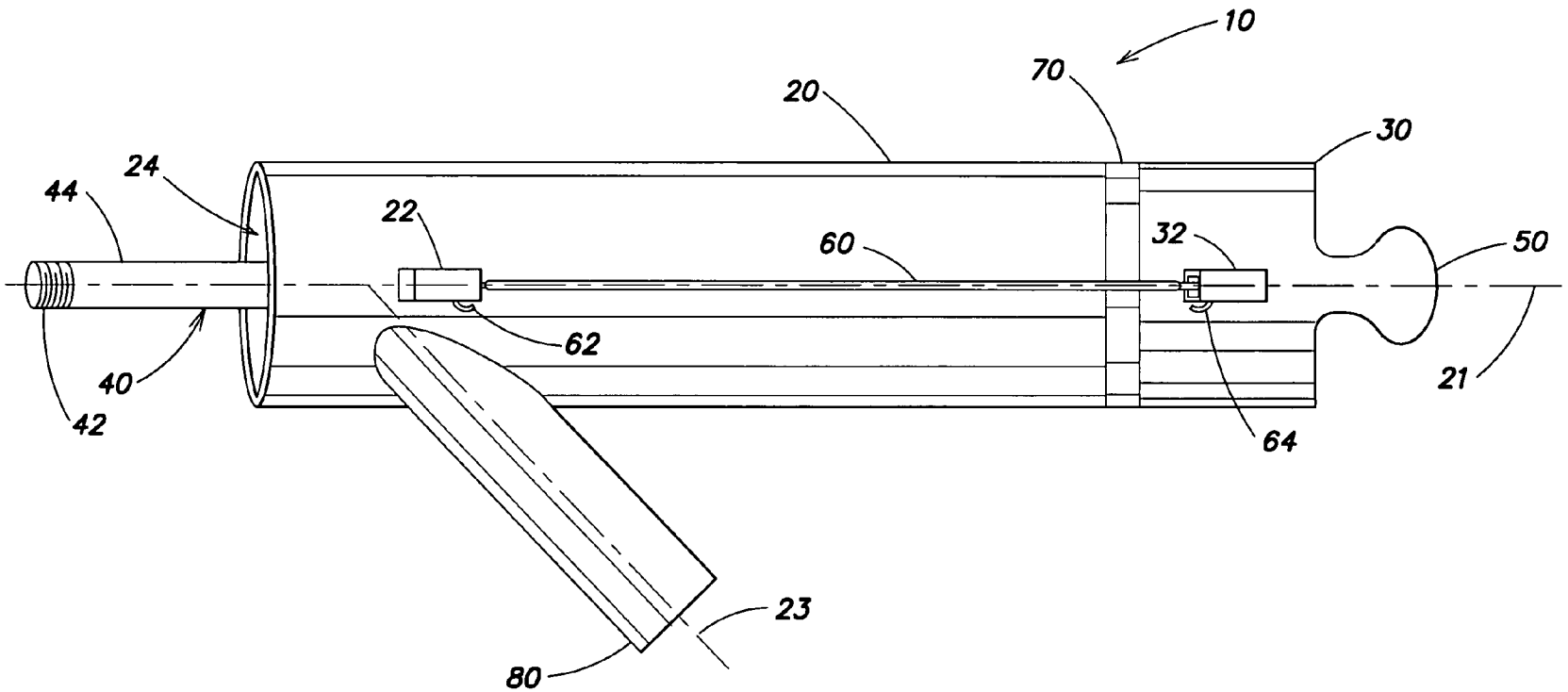
FIG. 2 is an elevation side view of a device for projecting an object according to another embodiment of the present invention.

As shown in FIG. 2, the housing 20 may be formed from a hollow cylindrical tube, or the like, having a passageway 24 therethough. The tube may be thin-walled or thick-walled, depending upon the application and the material used to form the housing 20. In other embodiments, the housing and/or passageway 24 may have other configurations. For example, the housing and/or passageway 24 may have square or rectangular cross-sections.

Figure 5:
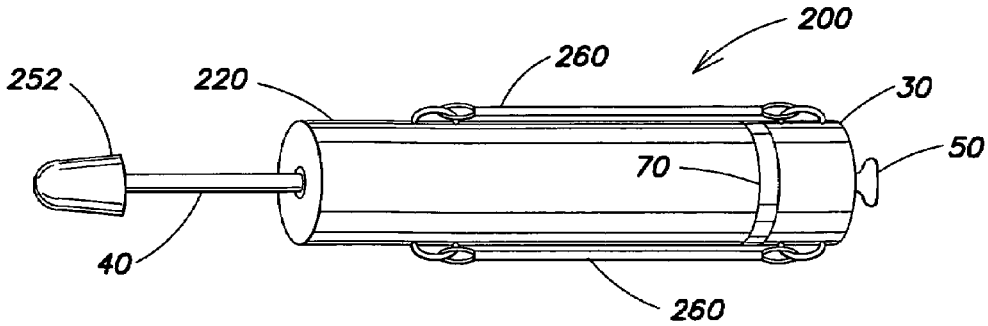
FIG. 5 is a perspective view of device for projecting an object according to another embodiment of the present invention in a relaxed mode.
Figure 6:
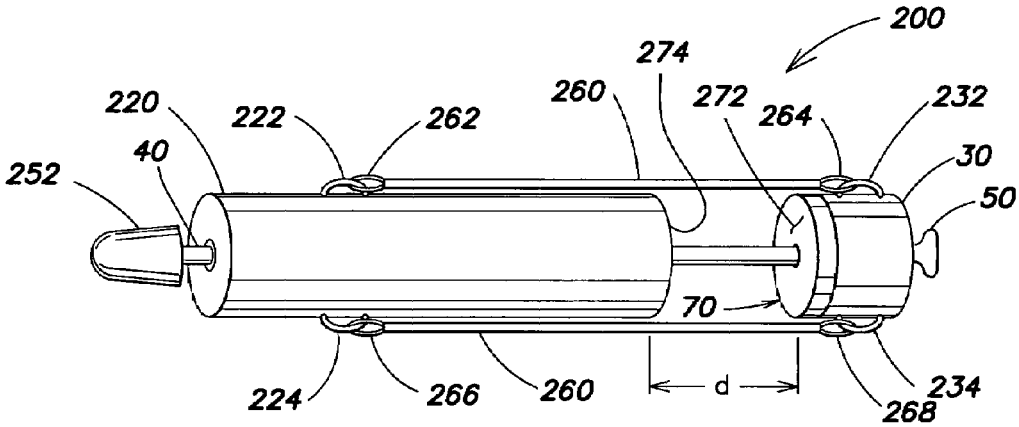
FIG. 6 is a perspective view of the device of FIG. 5 in a pre-firing mode.
Figure 7:
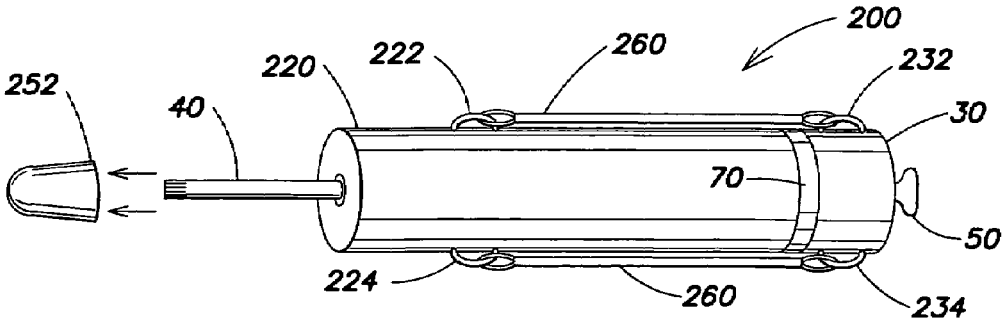
FIG. 7 is a perspective view of the device of FIG. 5 in a post-firing mode.

Further, in other embodiments, as illustrated in FIGS. 5-7, a housing 220 is formed from a generally solid cylindrical piece with an axial bore extending therethrough to create a passageway for the linkage 44 coupling retractor mechanism 30 to projectile mount 40. It should be appreciated that the housing and passageway may be formed in a variety of different ways as the present invention is not limited in this respect.

Retractor Mechanism

The retractor mechanism 30 is coupled to the projectile mount 40 by linkage 44 such that when the retractor mechanism 30 is separated from the housing 20, potential energy is stored in the resilient member 60. Once the retractor mechanism is released back towards its original position, a portion of this potential energy is transferred into movement of the object from the projectile mount.

Figure 3:
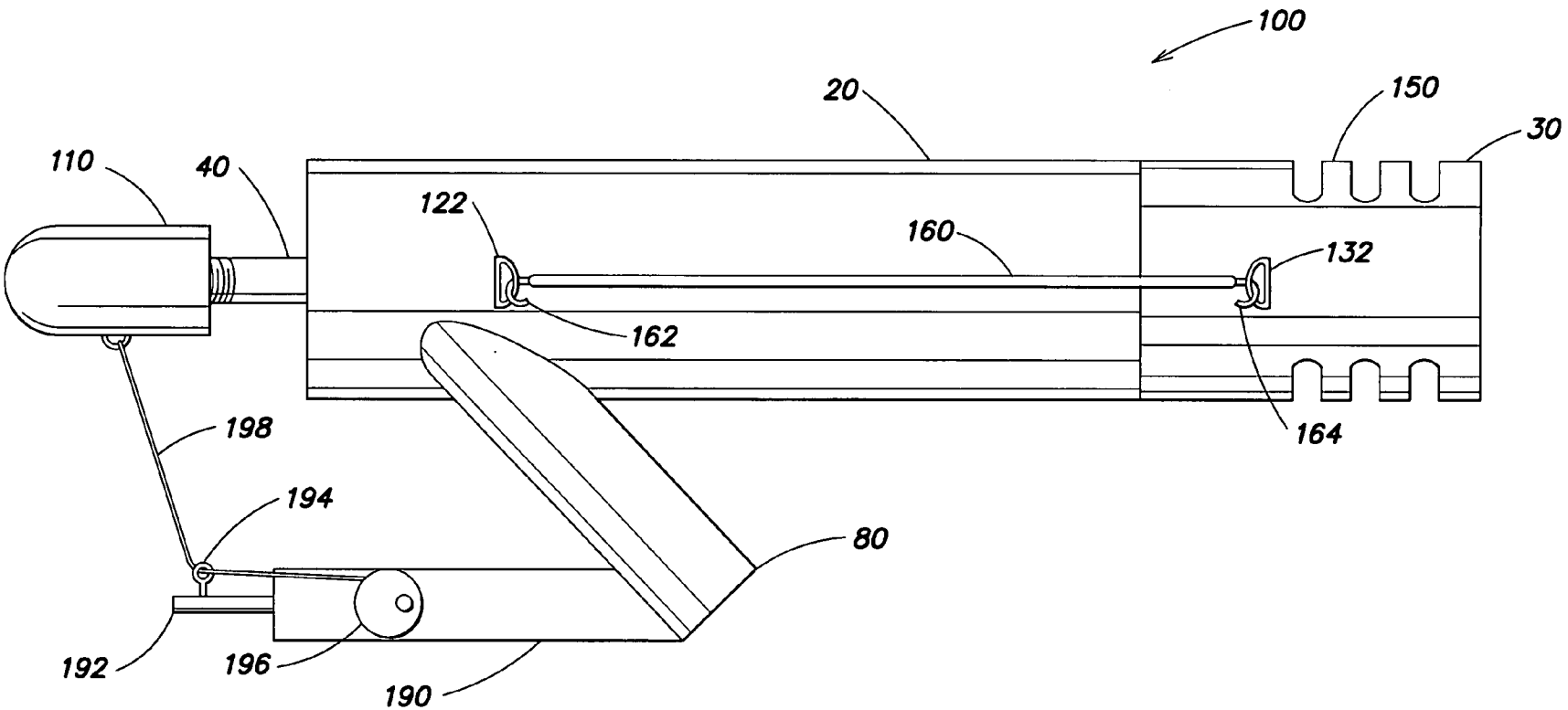
FIG. 3 is an elevation side view of device for projecting an object according to yet another embodiment of the present invention illustrating a reel assembly.

To facilitate movement of the retractor mechanism 30 away from the housing, in one embodiment, a grip, such as a knob 50, is coupled to the retractor mechanism 30. The knob 50 allows a user to grasp the mechanism 30, enabling one to manually draw retractor mechanism 30 away from housing 20. As shown in FIG. 1, in one embodiment, the knob 50 is formed integrally with the retractor mechanism 30. However, as shown in FIG. 2, in other embodiments, the knob 50 may be a separate component and may be removably attached to the retractor mechanism 30. In yet other embodiments, grip may include a handle, or projections or depressions on retractor mechanism 30, such as on the outer surface of the retractor mechanism 30. For example, FIG. 3 illustrates depressions 150 molded into the retractor mechanism for grasping the mechanism 30.

Figure 8:
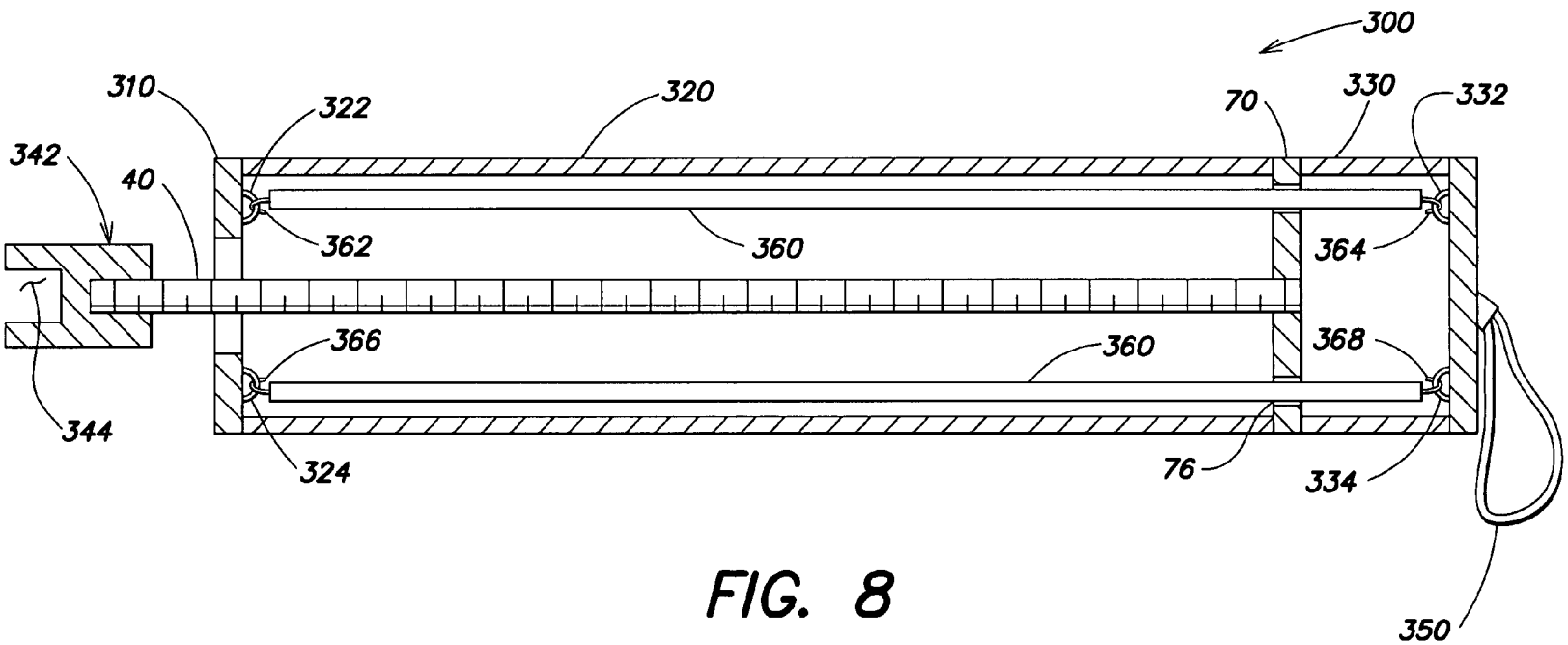
FIG. 8 is a cross-sectional side elevation view of a device for projecting an object according to another embodiment of the present invention.

In some embodiments, it may be desirable to construct the device 10 out of lightweight components. This is particularly advantageous if the device is sized to be portable. For example, as shown in FIG. 8, rather than using a knob 50 as a grip, it may be desirable to use a lightweight strap 350 as a grip. The strap 350 may be made from a variety of materials, such as leather, plastic, etc., as the present invention is not limited in this respect.

Figure 12:
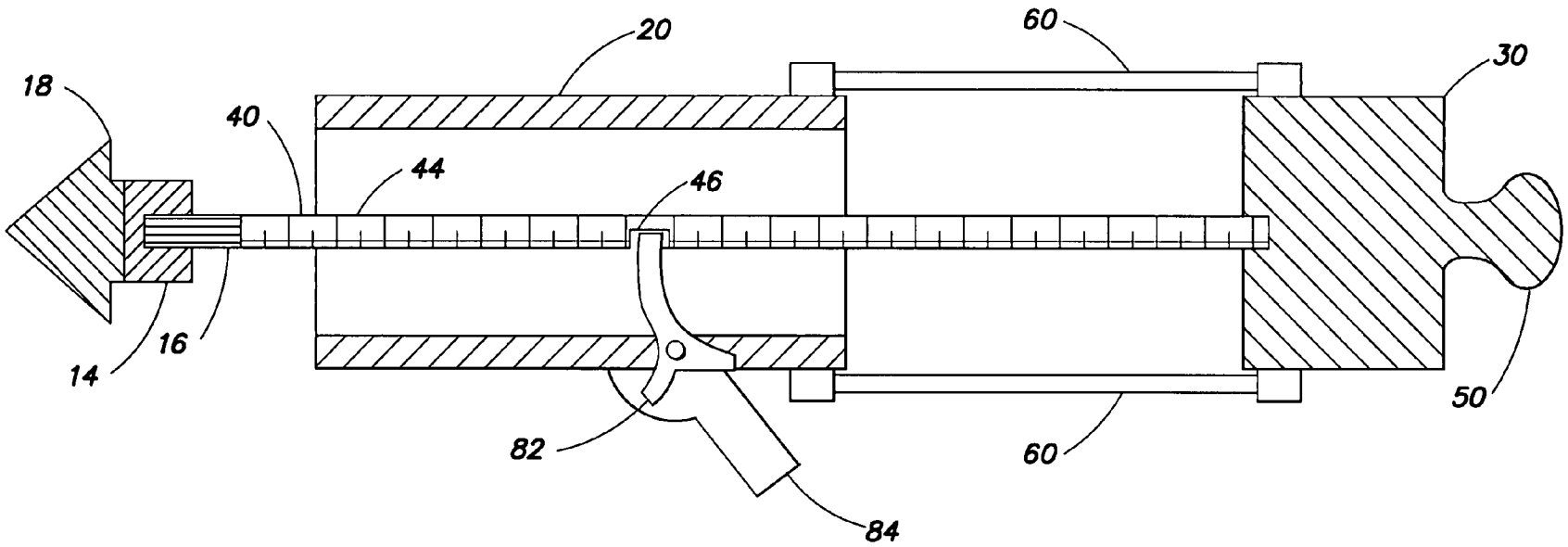
FIG. 12 is a cross-sectional side elevation view of a device for projecting an object according to one embodiment of the present invention.

In contrast to the manual mode of operation, in other embodiments, the retractor mechanism 30 may be withdrawn relative to the housing by another mechanism, and in some embodiments, it may be configured for automated control. In some embodiments, a mechanism (not shown) may be provided to drive the relative movement of these components. For example, a ratchet mechanism, or a crank mechanism may be employed to withdraw the retractor mechanism relative to the housing. In some embodiments, as shown in FIG. 12, triggers and/or latches may be employed to temporarily lock the position of these components. When desired, the user can unlock the components to release the retractor mechanism back toward the housing. For example, as shown in FIG. 12, a locking mechanism 82 is provided to mate with a notch 46 located in either the linkage 44 or projectile mount 40. The retractor mechanism 30 is pulled back until the locking mechanism 82 aligns with the notch 46. Thereafter, the locking mechanism 82 is rotated, unlocking the locking mechanism from the notch to propel the retractor mechanism 30 forward. In one embodiment, a handle 84 is provided to house the locking mechanism 82 as shown in FIG. 12. It should be appreciated that in one embodiment, the locking mechanism 82 may rest against a protrusion located on the linkage 44 or projectile mount 40 rather than rest within a notch 46. In one embodiment, various other types of locking mechanisms including a spring loaded pin and/or various camming surfaces may be provided. In one embodiment, when a protrusion is formed on the linkage 44 or projectile mount 40, a matching slit or recess may be provided inside the housing 20 along the length of the housing to prevent friction between components. Further, in some embodiments, the device may be configured for automated control. It is to be understood that the invention is not limited to any particular retractor mechanism.

Projectile Mount

Projectile mount 40 is configured to hold an object for projecting. As shown in FIGS. 1 and 2, typically, projectile mount 40 may be a rod. However, in one embodiment, illustrated in FIG. 4, the projectile mount is a cup-shaped holder. In yet other embodiments, the projectile mount may include a tube, or a net, etc.

In one embodiment, the first end 42 of the mount 40 may include a frictional surface to help secure an object 252 to the projectile mount 40. For example, in the embodiment illustrated in FIG. 2, the first end 42 of the mount 40 has parallel or spiral threads to provide a frictional engagement with an object 252 (see FIGS. 5-7). Alternatively, as shown in FIG. 7, ridges may extend along the projectile mount 40 in a longitudinal direction. In other embodiments, the frictional surface may be provided with a roughened end, or with a rod having a slightly enlarged tip area.

The threads or ridges may loosely interact with a frictional surface located on the object 252 being projected from the device. For example, in one embodiment, as illustrated in FIGS. 5-7, the object 252 may have a cavity (not shown) for receiving a portion of the projectile mount 40. This cavity may further be provided with a frictional surface, such as threads or ridges, to prevent the object 252 from falling off the device 200 before it is projected. However, it should be appreciated that if the engagement between the projectile mount 40 and the object 252 is too strong, the object 252 may not detach from the projectile mount to permit the object to be launched. Accordingly, it should be appreciated that some clearance room may be desirable. As shown in FIG. 12, in one embodiment, the first end 42 of the mount 40 may include a magnetic material 16. The magnetic material 16 may help secure an object 18 to the first end 42 of the mount when the object 18 also has an attracting magnetic material 14. This may be particularly beneficial when the device is positioned to propel as on object in a downward direction.

Further, in one embodiment, portions of the projectile device, such as the projectile mount may be fluted and/or may include dimples. A fluted configuration and/or dimples may be advantageous to reduce the weight of the device, and they may also reduce friction and drag, and assist in the movement of the components.

As discussed below, in other embodiments, an adaptor 342 may be added to the first end of the projectile mount 40 so that other types of objects may be secured to the projectile mount 40. A frictional surface, such as spiral threads, or a magnetic material may be useful on the first end 42 of the projectile mount 40 to removably secure the adaptor 342.

Figure 4:
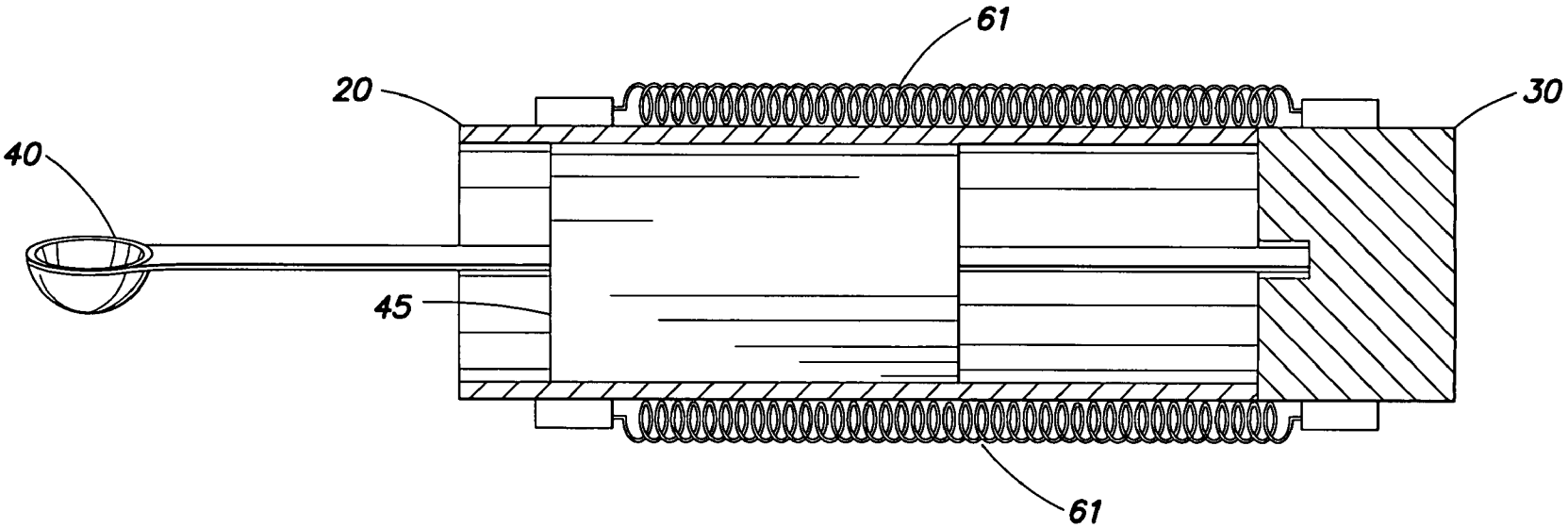
FIG. 4 is a partial, cross-sectional side view of a device for projecting an object according to yet another embodiment of the present invention.

In the embodiment illustrated in FIG. 2, the projectile mount 40 is disposed at one end of a rod which extends to and is directly coupled to the retractor mechanism 30. In other words, in some embodiments, linkage 44 coupling the projectile mount 40 to the retractor mechanism 30 is an extension of the projectile mount itself. However, it should be appreciated that in other embodiments, the projectile mount 40 may be coupled to the retractor mechanism 30 through a different type of linkage 44, such as a tube, a piston, or the like. For example, as shown in FIG. 4, the projectile mount 40 is coupled to the retractor mechanism 30 through piston 45.

Resilient Members

At least one resilient member is secured to the retractor mechanism 30. The resilient member is also anchored on another portion of the device, for example, on the housing 20. Accordingly, when the retractor mechanism 30 is withdrawn away from the housing 20, the resilient member 60 is stretched to store potential energy.

In some embodiments, only one resilient member 60 is provided. However, in other embodiments, a plurality of resilient members 60 extend between housing 20 and retractor mechanism 30. For example, two resilient members 60 may be provided, one on each side of the housing 20. As shown in FIGS. 1 and 2, each resilient member 60 typically is attached at one end to the outer surface of the housing 20 and at the other end to retractor mechanism 30. Each resilient member 60 may be attached directly to these components, or via a connector 22, 32 located on housing 20 and retractor mechanism 30 respectively. As shown in FIG. 2, in one embodiment, the connectors may be padlock eyes on housing 20 and retractor mechanism 30 which connect with resilient member hooks 62, 64 respectively.

However, the resilient members 60 may be coupled to housing 20 and retractor mechanism 30 in a variety of different configurations, as the present invention is not limited in this respect. For example, hooks, rings, pins, recesses, magnets, or adhesive could be used to couple the resilient members 60 to the housing 20 and/or the retractor mechanism 30. In the embodiment disclosed in FIGS. 5-7, C-shaped hooks 222, 224, 232, 234 are spaced apart on the outer surface of both the housing 220 and the retractor mechanism 30 to secure the resilient members 260. Rings 262, 264, 266, 268 are provided at each end of the resilient members and are secured to the C-shaped hooks. To reduce the weight of the device, as shown in FIG. 3, smaller rings 122, 132 on the housing 20 and the retractor mechanism 30 may be attached to hooks 162, 164 located on each end of the resilient member 160.

It should also be appreciated that in some embodiments, a resilient member 60 may be attached to housing 20 in a manner differently than it is attached to retractor mechanism 30. Likewise, one resilient member 60 may be attached to housing 20 and retractor mechanism 30 in a manner differently from another resilient member 60.

Figure 9:
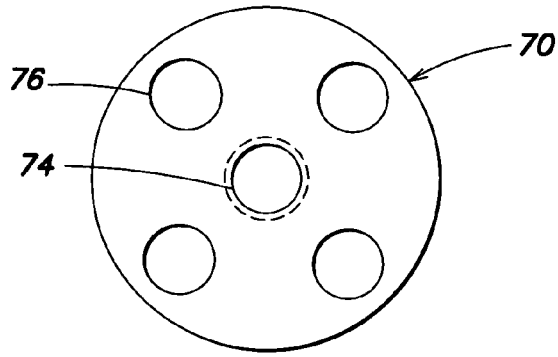
FIG. 9 is a front elevation view of a connector plate according to one embodiment of the present invention.

Although the resilient members may be coupled to the outer surface of both the housing and the retractor mechanism, in other embodiments, the resilient members may be located within the housing and/or the retractor mechanism. As illustrated in the cross-sectional view of FIG. 8, the device 300 includes a housing 320 and a retractor mechanism 330, with two resilient members 360 located within a passageway defined by the housing 320 and retractor mechanism 330. Linkage 44 extends through the passageway and is secured to a connector plate 70. In this particular embodiment, the second end of the projectile mount 40 is threadably engaged to the connector plate 70. Rings 332, 334 on the end of the retractor mechanism 330 connect to hooks 364, 368 located on the back end of the resilient members 360. Similarly, at the front end of the device 300, a housing cap 310 also includes rings 322, 324 which connect to hooks 362, 366 located on the front end of the resilient members 360. As shown in FIGS. 8 and 9, openings 76 may be provided within the connector plate 70 to permit the resilient members to extend and stretch therethrough.

In one embodiment, the resilient members may be formed from bands of a stretchable elastic material. In some embodiments, such as shown in FIGS. 1-3, bungee cords may be employed, while in other embodiments, such as in FIG. 4, springs 61 may be used. Various types of energy storing materials, such as extension springs and stretchy and/or elastic materials may be utilized, as the present invention is not so limited.

It should also be appreciated that the characteristics of the resilient member will affect the amount of force required to move the retractor mechanism back a certain distance. Therefore, the characteristics of the resilient member will affect how far and how fast an object may be capable of being propelled from the device. In one embodiment, the resilient members are bungee cords, and when the retractor mechanism is drawn back approximately 12", an object, such as a toy arrow weighing approximately 6 ounces, is projected a distance of approximately 150 feet. In another embodiment, the toy arrow is projected up to 300 feet. Of course it should be appreciated that when the weight of the object increases, the distance it will be propelled or projected from the device will be affected by its inertia and gravity. It should also be recognized that environmental factors, such as wind, will also vary the distance that an object will travel away from the device.

Connector Plate

As shown in FIG. 2, in one embodiment, retractor mechanism 30 may include a connector plate 70 to couple the retractor mechanism 30 to linkage 44, which couples mechanism 30 to projectile mount 40. As shown in FIG. 9, the connector plate 70 may include a threaded opening 74, which is threaded onto linkage 44, to removably secure the projectile mount 40 to the retractor mechanism 30. In other embodiments, the connector plate 70 may include other openings 76 to reduce the overall weight of the connector plate.

As discussed above with reference to FIGS. 8 and 9, in alternative embodiments, the resilient members are positioned within the housing 20, and a connector plate 70 may include additional openings 76 to allow the resilient member to pass therethrough from the inside of the housing 20 to the inside of the retractor mechanism.

Turning to FIGS. 5-7, when the retractor mechanism strikes back face 274 of the housing 220, a loud sound may result due to the impact of the two surfaces. In some embodiments, it may be desirable to reduce or muffle this sound. Accordingly, in some embodiments the front face 272 of the retractor mechanism 30 and/or the back face 274 of the housing 220 may include a noise dampening washer. For example, at least one of these surfaces may include a compressible rubber or foam material. As discussed above, in one embodiment, a connector plate 70 is provided on the retractor mechanism 30 to couple the retractor mechanism 30 to the projectile mount 40. In this embodiment, the front face 272 of the retractor mechanism 30 may be located on the connector plate 70, and the connector plate 70 may include the noise dampening washer material. However, in other embodiments, a noise dampening washer may also be coupled to the back face 274 of the housing 220, such that the noise dampening material acts as the strike plate.

It should be appreciated that if another component is positioned between the retractor mechanism and the housing, that component may be considered to be part of either the housing or the retractor mechanism for the purpose of defining the front face of the retractor mechanism and/or the strike plate on the housing, even if that component is not directly adjacent to either the retractor mechanism or the housing.

Arm and Arm Attachments

As shown in FIG. 2, in one embodiment, an arm 80 may extend from housing 20. The arm 80 is configured to enable a user to comfortably grasp it. For example, one hand may be placed on the arm 80, while the other hand may be used to grasp the grip, such as knob 50, to withdraw the retractor mechanism 30 from the housing 20. In some embodiments, the arm 80 is positioned near a front end of the device 10 adjacent the projectile mount 40. Arm 80 helps provide stability when device 10 is operated with two hands. Arm 80 may be particularly useful for propelling heavy objects. In some embodiments, it may be advantageous to position arm 80 at an acute angle with respect to the axis 21 or the direction of elongation of the housing 20 so that a user can hold device 10 in a natural hand position to reduce any strain on the arm. For example, as shown in FIG. 2, the longitudinal axis 23 of the arm 80 may be at an angle of 17°, 30°, 45°, or 60° with respect to the longitudinal axis 21 of the housing 20. Arm 80 may be attached to housing 20 with a fastener such as a screw or wooden dowel peg, a standard locking mechanism, and/or an adhesive, such as Gorilla Glue™. Alternatively, arm 80 could be molded unitary with housing 20. In other embodiments, the arm 80 may be detachable from housing 20.

As shown in FIG. 3, in some embodiments, the device 100 has an arm attachment 190 which may include a reel assembly 196 secured to the arm 80. The arm attachment 190 may be arranged similar to a conventional fishing pole, including a pole 192 having a loop 194 secured at its tip. The arm attachment 190 may be secured to the arm 80 with a fastener such as a screw or a wooden dowel peg, a standard locking mechanism, and/or may be reinforced with an adhesive, such as Gorilla Glue™. Alternatively, the arm attachment could be molded unitary with housing 20 and/or arm 80. In one embodiment, the pole 192 is detachable from the end of the arm attachment 190, for example, with a fastener such as a screw, and may be made from a material such as plastic, fiberglass, or graphite. Fishing line 198, or some other type of rope/string may be coiled around the reel assembly 196 and threaded through the loop 194 on the pole 192. The end of the line 198 may be secured to the object 110 which is being projected or propelled from the device 100 so that the object may be located and/or retrieved afterwards. Once the object has been recovered, the line 198 may be recoiled in the reel assembly 196 for subsequent use.

This type of arm attachment 190 may be advantageous for using with a variety of types of objects. For example, in one embodiment, this type of arm attachment 190 is used with a toy, such as a toy space shuttle, which may be projected or propelled far away from the user. The arm attachment 190 may additionally be useful when the object may land in a water environment.

In another embodiment, the arm attachment may be used with climbing and/or rescue equipment to project or propel a safety cord to someone being rescued or over a wall or into a tree, etc. In this particular embodiment, the object being projected may be used primarily as a weight, assisting in directing the safety cord out away from the device. In other embodiments, arm attachments 190 may be useful in military applications, where the object 110 being projected may, for example, be a video or audio recording device which the user may want to retrieve after the recording.

Instead of, or in addition to the fishing pole 192 attachment, other types of attachments may be used with the arm attachment 190, including winches, pulleys, blades, claw-like attachments useful for climbing, etc., as the present invention is not limited in this respect.

Adaptors

As mentioned above, in some embodiments, an adaptor 342 (as shown in FIG. 8) is attached to the first end of the projectile mount 40 so that the device 300 is capable of projecting a particular sized and shaped object. For example, in one embodiment, the first end of the projectile mount 40 is generally cylindrically shaped, having a tip diameter of about ½". Accordingly, an object that is sized to align and mate with a ½" diameter cylindrical extension is capable of being held by and projected or propelled from the projection mount 40.

However, in other embodiments, it is advantageous to propel an object that may not be sized and shaped to fit on the projectile mount 40 by itself. Accordingly, a variety of different sized adaptors 342 may be provided to permit a wide variety of objects to be projected or propelled from the device 300. The adaptors 342 may be removably coupled to the mount 40, and in one embodiment, adaptors 342 are threadably attached to the mount. Adaptors 342 may be constructed to provide a tip that is either larger or smaller than the first end of the projectile mount 40. As shown in FIG. 8, adaptors 342 may include a cavity 344, so that an object having a protrusion can interface with and eject from the projectile mount 40, as the present invention is not limited in this respect. In one embodiment, the adaptor 342 may include a magnetic material to assist in holding an object to the adaptor 342. For example, the object may include an attracting magnetic material. In another embodiment, the adaptor 342 may include a magnetic material to assist in securing the adaptor 342 to the projectile mount 40.

It should be appreciated that the present invention encompasses a variety of types of adaptors 342 to permit the device 300 to interface with a large assortment of types of objects for projecting. For example, in one embodiment, an adaptor 342, such as a cup attachment, may be coupled to the first end of the projectile mount 40. Accordingly, a variety of materials may be placed within the cup.

Safety Features

Figure 10:
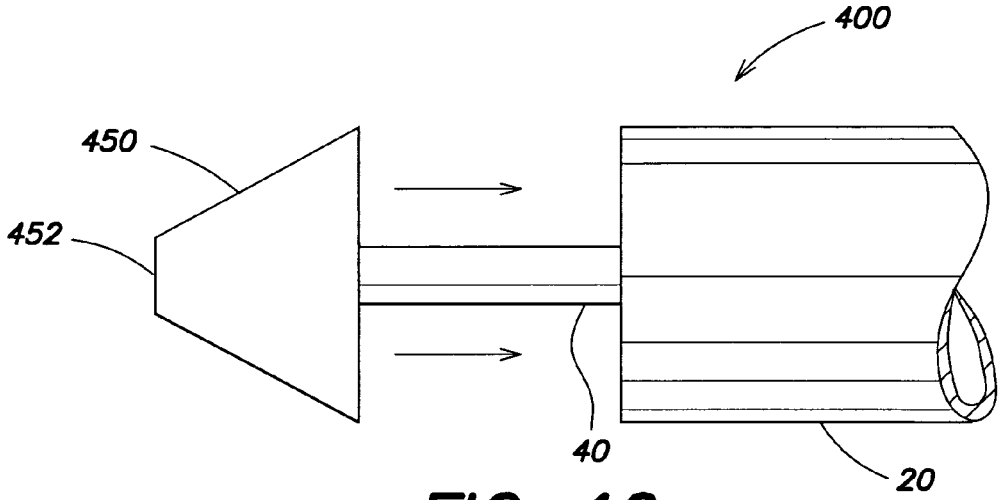
FIG. 10 is a partial side, elevation view of a device for projecting an object illustrating a safety cap according to one embodiment of the present invention.
Figure 11:
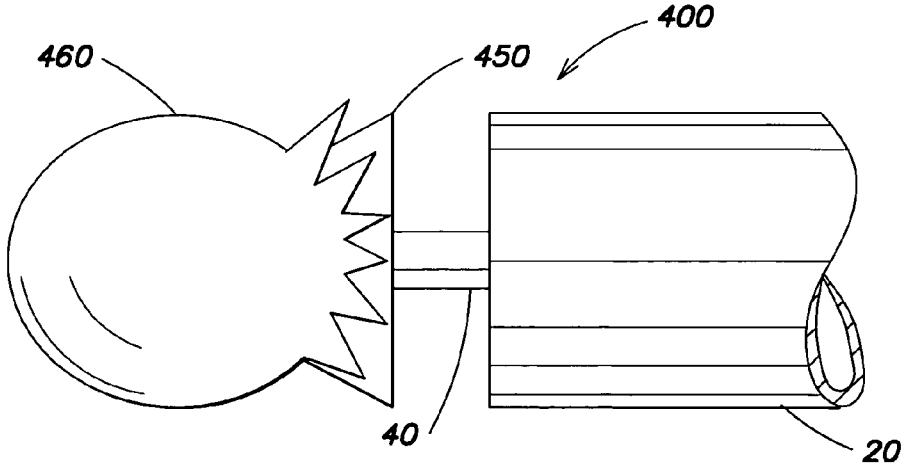
FIG. 11 is a partial side, elevation view of the device and safety cap illustrated in FIG. 10, shown with a toy.

Turning now to FIGS. 10 and 11, in some embodiments, it may be beneficial to incorporate a safety cap 450 with the device 400. This may be particularly useful when the present invention is used as a toy. However, it may also be a useful safety feature in other embodiments as well. In this particular embodiment, a safety cap 450 having a forward opening 452 is slidably coupled to the first end of the projectile mount 40 to cover the tip of the projectile mount 40. The safety cap 450 may be spring-loaded and biased in a position so that the end of the projectile mount 40 is recessed below opening 452 (similar to FIG. 10). As shown in FIG. 11, when an object, such as a toy 460, is placed on the projectile mount 40, the safety cap slides back along the mount 40 so that mount 40 temporarily extends through opening 452 to allow attachment of the toy 460. Once the toy 460 is positioned on the mount 40, the retractor mechanism (not shown) is separated from the housing 20 as described above. When the toy 460 is propelled from the device 400, the safety cap then springs forward to cover the first end of the mount 40, as shown in FIG. 10. In one embodiment, the safety cap is made from a resilient material, such as a foam, to further prevent the projectile mount from causing injury.

Method of Use

In some embodiments, the device may be used simply for recreational purposes, and it may launch arrows, toys, sporting devices, etc. In other embodiments, the device may be used for self-defense or military purposes and it may launch weapons. In further embodiments, the device may be used for safety/rescue purposes, and it may launch life saving devices, climbing tools, etc. In one embodiment, the device may be used as a survival tool, such that one can use the device to propel weapons for hunting, fishing, while also using the device to propel a tethered line which may be used to build a shelter. Further, in some embodiments, the outer surface of the housing may be provided with a universal mounting for use with scopes, flashlights, etc.

One embodiment of the method of this invention is illustrated in FIGS. 5-7, in which the device 200 projects or propels an object 252, such as a projectile, from the first end of the projectile mount 40 by axial movement of projectile mount 40 relative to the housing 220. The object 252 is positioned on the end of the projectile mount and may be secured by frictional engagement, such as with threads, ridges, magnets, etc. In a relaxed position, the front face 272 of the retractor mechanism 30 is aligned with and adjacent to the back face 274 of the housing 220. The back face 274 of the housing defines a strike plate. As shown in FIGS. 5-6, first, a user draws the retractor mechanism 30 axially back a distance "d" while keeping the housing 220 stationary. This movement may be done manually by gripping the knob 50, and may also be performed with further mechanisms. This movement causes the resilient members 260 to stretch and to store energy. Thereafter, the user releases his/her grip on the knob 50 and the retractor mechanism 30 and projectile mount 40 axially spring forward. Once the movement of the retractor mechanism 30 is arrested by the back face 274 of housing 220 (as shown in FIG. 7), the forward momentum is transferred to object 252, causing it to be propelled off the projectile mount 40.

As discussed above, in some embodiments, the device may include an arm attachment 190 which may include a reel assembly 196. In one embodiment, the reel assembly 196 is wound with a line 198 of rope/string, and one end of the line 198 is secured to an object positioned on the projectile mount prior to its projection. The reel assembly may further include a pole 192 having a loop 194 at its tip, and the line 198 may be threaded through the loop 194 prior to being secured to the object. Thereafter, the retractor mechanism is pulled back and released to project the object. As the object is projected, the line 198 unwinds from the reel assembly and travels out with the object. Because the line 198 stays attached to the object, the location of the object can be determined by following the line, and/or by pulling the line back, much like a fishing pole.

It should be appreciated that when the resilient members are located within the housing, such as in the embodiment of FIG. 8, the device 300 may be operated similar to any of the above embodiments having resilient members on the outside of the housing. The retractor mechanism 330 may be drawn back either manually or automatically relative to the housing 320 to store energy in the resilient members 360. The openings 76 in the connector plate 70 allow the resilient members 360 to stretch though the plate 70 inside of the housing 320 as the retractor mechanism 330 is separated from the housing 320.

Further, when a safety cap 450 is employed, it may be either permanently or removably attached to the projectile mount 40. A device having such a safety cap would operate much the same way as any of the embodiments described above, except that the safety cap may slide back along the projectile mount as an object 450 is secured onto the projectile mount. Thereafter, the object may be projected from the device as discussed above.

Shape, Size, and Materials of Construction

In one embodiment, the device 100 is constructed to have a streamlined configuration. For example in the embodiment of FIG. 3, the arm attachment 190 is substantially parallel to the housing 20, and the arm 80 extends along a diagonal, such that the overall device 100 has a Z-shape (from the opposite view as shown in FIG. 3). In one embodiment, the housing 20, arm 80, and arm attachment 190 all extend substantially within the same plane However, in other embodiments, the arm attachment 190 and/or the arm 80 may extend out to the side of the housing 20.

Various components, such as the housing 20, retractor mechanism 30, arm 80, and arm attachment 190 may be made from lightweight components such as plastic, metal, or wood, etc. Some or all of these components may also be hollow to further reduce the overall weight of the device. In one embodiment, these components are injected molded plastic, however, in other embodiments, some or all of the components may be made from wood, such as poplar wooden dowels. The projectile mount may also be made from a lightweight material, such as aluminum, fiberglass, or plastic, and may also be injection molded. However, in some embodiments, the projectile mount may be made from a heavier, more rigid material, such as steel, if the object being projected is heavy, like as a blade or spear.

The device may be sized and manufactured with components that enable a user to easily carry the device. For example, in one embodiment, the length of the housing may be approximately 10", the length of the retractor mechanism, including connector plate and knob may be approximately 4.5", and the length of each resilient member may be about 12". In this embodiment, the housing, connector plate, and retractor mechanism each have a circular cross-sectional shape with a diameter of about 1¼", and in one embodiment, the connector plate is made from ⅜" thick piece of plastic or a metal, such as aluminum. The projectile mount may be between 15-30" long, and in one embodiment is about 25" in length.

It should be appreciated that the longer the projectile mount is relative to the housing, the farther the distance "d" a user can draw back the retractor mechanism to generate energy to propel an object. In some embodiments, if the object on the projectile mount is wider than the passageway for the mount in the housing, the retractor mechanism may only be drawn back until the object on the projectile mount approaches the opening to the passageway. However, in some embodiments, if the opening to the passageway is bigger than the object on the projectile mount, the retractor mechanism may be drawn back farther, such that the object slides at least partially into the passageway before it is projected from the device.

Alternative Embodiments

It should be appreciated that in some embodiments, rather than maintaining the housing 20 in a stationary position, the housing 20 may be moved in a forward direction away from the retractor mechanism 30 to store energy in the resilient members 60. Thereafter, a user may release the retractor mechanism 30 to project an object from the projectile mount 40. For example, in one embodiment, a user may push the housing 20 away from the retractor mechanism 30 using arm 80 to stretch the resilient members 60. In some embodiments, the movement of the housing relative to the retractor mechanism may be driven by a ratchet mechanism or a crank arm, or both, and may be automated.

In some embodiments, the device may impart a rotational spin to the object. Accordingly, the object may be projected or propelled from the device with both translational and rotational movement. For example, in one embodiment, a retractor mechanism 30 may be drawn back away from the housing 20, while also rotating the retractor mechanism 30 about its axis. In one embodiment, the retractor mechanism 30 may be manually rotated 90°, 70°, 360° or even more, before it is released back towards the housing 20. This causes the retractor mechanism 30 to rotate back to its original configuration when released. In other embodiments, a spiral track may be positioned inside of the housing so that the retractor mechanism is automatically rotated as it to drawn back. It should be appreciated that this rotational spin may be imparted onto the object either manually, or through a torquing mechanism.

To prevent an object from being accidentally propelled from the device, typically there are no triggers or latches which hold the retractor mechanism 30 back away from the housing 20 after it is separated from the housing. The user may control when an object will be propelled from the device based upon when he or she releases the retractor mechanism 30. Further, in some embodiments, some or all of the components are made with soft plastics or foam materials to further prevent any accidental injury.

It should further be appreciated that the above device may be used as a system or platform to propel a variety of different objects for a variety of different purposes. For example, in some embodiments, the device may come equipped with a plurality of different adaptors which may be removably coupled to the projectile mount so that the device may be used to project or propel a variety of sized and shaped objects. In some embodiments, the device may come equipped with a plurality of resilient members having different elasticity values or spring constants, such that different resilient members may be coupled to the device, depending on the specific application.

In some embodiments, it may be desirable to have a portable and modular propulsion device. Accordingly, the device may be configured with detachable components so that the device can be easily broken down into a smaller storage configuration. For example, the arm and arm attachments may be removably coupled to the housing, and the resilient members may attach to the housing and retractor mechanism with hook components that are easily removable.

Further, when the device has detachable components, various components may be interchangable depending upon the particular application. For example, light duty bungee cords may connect to the housing and the retractor mechanism when the device is used to project lightweight objects, such as toys. However, these may be easily replaced with heavy duty bungee cords when the device is used for self-defense or rescue purposes. Similarly, heavy components, such as knob 50 may be easily replaced with a lightweight strap 150 when the device is to be carried around by a user for a long period of time.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A device for projecting an object, the device comprising:

a projectile mount configured to hold an object to be projected;

a housing;

a retractor mechanism coupled by a linkage to the projectile mount for producing movement of the projectile mount relative to the housing;

at least one resilient member, at least one end of the resilient member being coupled to the housing, and the resilient member engaging the retractor mechanism, wherein relative movement of the retractor mechanism away from the housing stores energy in the resilient member, and relative movement of the retractor mechanism towards the housing transfers the stored energy into movement of the projectile mount, wherein the at least one resilient member includes a band of elastic material, at least a portion of the at least one resilient member being positioned externally of at least a portion of the housing; and wherein the retractor mechanism further comprises a connector plate, wherein the projectile mount is removably coupled to the connector plate.

2. A device for projecting an object, the device comprising:

a projectile mount configured to hold an object to be projected;

a housing;

a retractor mechanism coupled by a linkage to the projectile mount for producing movement of the projectile mount relative to the housing;

at least one resilient member, at least one end of the resilient member being coupled to the housing, and the resilient member engaging the retractor mechanism, wherein relative movement of the retractor mechanism away from the housing stores energy in the resilient member, and relative movement of the retractor mechanism towards the housing transfers the stored energy into movement of the projectile mount, wherein the at least one resilient member includes a band of elastic material, at least a portion of the at least one resilient member being positioned externally of at least a portion of the housing; and a safety cap slidably coupled to the projectile mount to cover at least a portion of the projectile mount when an object is not coupled to the projectile mount.

3. A device for projecting or propelling an object, the device comprising:

a projectile mount configured to hold an object to be projected;

a housing with a passageway therethrough;

a retractor mechanism coupled by a linkage to the projectile mount for producing movement of the projectile mount relative to the housing, the retractor mechanism having a front face, and the housing having a back face defining a strike plate, wherein the retractor mechanism is axially aligned with the housing, such that the front face of the retractor mechanism is adjacent the strike plate in a first position; and at least one resilient member coupled to the housing and engaging the retractor mechanism, the at least one resilient member extending externally of and adjacent to at least a portion of the housing, wherein relative movement of the front face of the retractor mechanism from the first position to a second position in which the front face of the retractor mechanism is spaced apart from the strike plate stores energy in the at least one resilient member, and release of the retractor mechanism allows the retractor mechanism to return to the first position which transfers the stored energy into movement of the retractor mechanism and the projectile mount.

4. The device of claim 3, further comprising a grip coupled to the retractor mechanism for movement therewith.

5. The device of claim 3, further comprising an arm attachment including a line for attaching to an object positioned on the projectile mount to locate and/or retrieve the object after it is projected from the device.

6. The device of claim 3, in combination with an object to be projected, wherein the object is selected from the group consisting of a toy, a military weapon, a rescue apparatus, and a survival tool.

7. The device of claim 3, wherein the retractor mechanism further comprises a connector plate, wherein the projectile mount is removably coupled to the connector plate.

8. The device of claim 3, further comprising a safety cap slidably coupled to the projectile mount to cover at least a portion of the projectile mount when an object is not coupled to the projectile mount.

9. The device of claim 3, wherein the projectile mount is directly coupled to the retractor mechanism.

10. The device of claim 3, wherein the projectile mount includes a rod extending out of the housing.

11. The device of claim 3, further comprising a mechanism for moving the front face of the retractor mechanism away from the strike plate.

12. A device for projecting or propelling an object, the device comprising:

a projectile mount configured to hold an object to be projected;

a housing with a passageway therethrough;

a retractor mechanism coupled by a linkage to the projectile mount for producing movement of the projectile mount relative to the housing, the retractor mechanism having a front face, and the housing having a back face defining a strike plate, wherein the retractor mechanism is axially aligned with the housing, such that the front face of the retractor mechanism is adjacent the strike plate in a first position;

at least one resilient member coupled to the housing and engaging the retractor mechanism, wherein relative movement of the front face of the retractor mechanism from the first position to a second position in which the front face of the retractor mechanism is spaced apart from the strike plate stores energy in the at least one resilient member, and release of the retractor mechanism allows the retractor mechanism to return to the first position which transfers the stored energy into movement of the retractor mechanism and the projectile mount; and a noise dampening washer located at least on either the strike plate or on the front face of the retractor mechanism to muffle the sound when the retractor mechanism contacts the housing.

13. A hand-held modular kit for projecting an object, the kit comprising:

a device comprising a housing, a projectile mount extending from the housing, the projectile mount being configured to hold an object to be projected, and a retractor mechanism removably coupled to the projectile mount for producing movement of the projectile mount relative to the housing;

a plurality of resilient members configured to be selectively removably coupled to the housing and removably engaged with the retractor mechanism, at least a portion of the plurality of resilient members have different elasticity values to vary the force required to move the retractor mechanism away from the housing, wherein the device is configured such that at least one resilient member is coupled to the housing and engaging the retractor mechanism;

wherein when the at least one resilient member is coupled to the housing and engaging the retractor mechanism, movement of the retractor mechanism with respect to the housing stretches the resilient member, and release of the retractor mechanism allows the retractor mechanism to move toward the housing and thrusts the projectile mount forward to project an object from the projectile mount; and a plurality of adaptors configured to be removably coupled to the projectile mount, wherein the adaptors have a variety of configurations to hold various types of objects, and wherein the device is configured such that at least one adaptor is coupled to the projectile mount.

14. The modular device of claim 13, in combination with an object for projecting, wherein the object is selected from the group consisting of a toy, a military weapon, a rescue apparatus, and a survival tool.

15. A hand-held modular kit for projecting an object, the kit comprising:

a device comprising a housing, a projectile mount extending from the housing, the projectile mount being configured to hold an object to be projected, and a retractor mechanism removably coupled to the projectile mount for producing movement of the projectile mount relative to the housing;

at least one resilient member configured to be coupled to the housing and engaged with the retractor mechanism, wherein when the at least one resilient member is coupled to the housing and engaged with the retractor mechanism, movement of the retractor mechanism with respect to the housing stretches the resilient member, and release of the retractor mechanism allows the retractor mechanism to move toward the housing and thrusts the projectile mount forward to project an object from the projectile mount;

an arm extending outwardly from the housing, wherein the arm is positioned at an acute angle with respect to the axis of the housing; and an arm attachment coupled to the arm, wherein the arm attachment is substantially parallel to the housing, such that the housing, arm and arm attachment form a substantially z-shaped configuration.

16. The modular kit of claim 15, wherein the housing, arm and arm attachment all extend substantially within the same plane.

17. The modular kit of claim 15, further comprising a plurality of components selectively removably coupled to the arm attachment, wherein the plurality of components includes at least one of a reel assembly, a fishing pole, a coiled line, a winch, a pulley, a blade, and a claw-like attachment.

18. The modular kit of claim 15, further comprising a plurality of resilient members configured to be selectively removably coupled to the housing and removably engaged with the retractor mechanism, at least a portion of the plurality of resilient members have different elasticity values to vary the force required to move the retractor mechanism away from the housing, wherein the device is configured such that at least one resilient member is coupled to the housing and engaged with the retractor mechanism.

19. The modular kit of claim 15, further comprising a plurality of retractor mechanisms configured to be selectively removably coupled to the projectile mount, wherein the plurality of retractor mechanisms includes at least one of a knob, a handle, and a strap.

20. The modular kit of claim 15, further comprising a plurality of projectile mounts configured to be selectively removably coupled to the retractor mechanism, wherein the plurality of projectile mounts includes at least one of a rod, a cup-shaped holder, a tube, and a net.

* * * * *